US007314089B2

(12) United States Patent
Howard et al.

(10) Patent No.: US 7,314,089 B2
(45) Date of Patent: Jan. 1, 2008

(54) METHOD OF WELLBORE PUMPING APPARATUS WITH IMPROVED TEMPERATURE PERFORMANCE AND METHOD OF USE

(75) Inventors: William F. Howard, West Columbia, TX (US); William C. Lane, The Woodlands, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 325 days.

(21) Appl. No.: 10/648,815

(22) Filed: Aug. 26, 2003

(65) Prior Publication Data

US 2005/0045332 A1 Mar. 3, 2005

(51) Int. Cl.
*E21B 43/12* (2006.01)

(52) U.S. Cl. ..... 166/370; 166/272.3; 166/272.7

(58) Field of Classification Search ..... 166/50, 166/68.5, 105, 57, 62, 302, 370, 272.3, 272.7
See application file for complete search history.

(56) References Cited

U.S. PATENT DOCUMENTS 3,485,300 A * 12/1969 Engle ..... 166/302
4,344,485 A 8/1982 Butler
4,524,827 A * 6/1985 Bridges et al. ..... 166/248
5,549,160 A * 8/1996 Bownes et al. ..... 166/250.08
5,607,016 A * 3/1997 Butler ..... 166/263
5,996,691 A * 12/1999 Norris et al. ..... 166/250.03
6,039,121 A * 3/2000 Kisman ..... 166/369
6,079,491 A * 6/2000 Stuebinger et al. ..... 166/68.5
6,412,557 B1 * 7/2002 Ayasse et al. ..... 166/272.3
6,533,033 B2 * 3/2003 Skillman ..... 166/105.1
2003/0159828 A1 * 8/2003 Howard et al. ..... 166/372

* cited by examiner

*Primary Examiner*—Lanna Mai
*Assistant Examiner*—Matthew J. Smith
(74) *Attorney, Agent, or Firm*—Patterson & Sheridan, LLP

(57) ABSTRACT

Oil is recovered from a borehole using a pump having limited high temperature breakdown resistance. The pump is located in a borehole having a cooling zone, in which the temperature of the well fluid is reduced to, or below, the temperature at which the temperature breakdown resistance of the pump is commercially acceptable. In one embodiment, the pump is a positive displacement pump which is mechanically driven from the well head location, such as through a rotating rod. The cooling zone is provided by positioning and controlling the pump to maintain a sufficiently low pressure at the pump intake to cause a portion of the liquid well fluid to vaporize prior to entry of the liquid into the pump, creating bubbles which pass upwardly in the wellbore in a zone passing the pump. The evolution of the vapor cools the well fluid to the acceptable temperature.

19 Claims, 3 Drawing Sheets

METHOD OF WELLBORE PUMPING APPARATUS WITH IMPROVED TEMPERATURE PERFORMANCE AND METHOD OF USE

BACKGROUND OF THE INVENTION

1. Field of the Invention

Embodiments of the present invention generally relate to the field of fluid extraction from bore holes. More particularly the present invention relates to artificial lifting devices and methodologies for retrieving fluids, such as crude oil, from bores where the fluid does not have sufficient hydrostatic pressure to rise to the surface of the earth of its own accord. More particularly still, the present invention relates to the field of recovery of such fluids, where the fluid temperature of the fluids in the well bore exceeds the temperature at which the sealing materials in the pump rapidly deteriorate, to the point of failure.

2. Description of the Related Art

The recovery of fluids such as oil and other hydrocarbons from bore holes, where the fluid pressure in the bore hole is insufficient to cause the fluid to naturally rise to the earths' surface, is typically accomplished by the pumping of fluid collected in the bore hole by mechanical or fluid mechanical means. Several methodologies are known to provide this pumping action, each with its own limitations.

In a one methodology, a rod extends down the well from a surface location to terminate in a production zone of a well, where it is connected to a rod pump. The rod pump generally includes a piston and piston-housing configuration, selectively ported to the well fluid production zone, and production tubing extending from the pump to the earths surface. The rod is attached to the piston, and it reciprocates upwardly and downwardly, such that during a down stroke thereof, well fluids received in the pump housing are compressed and ported to a production tube, and during the upstroke, a check valve opens and allows well fluids into the piston cavity to be compressed on the next down stroke. Thus the recovery rate is dependant upon the stroke of the rod and the number of strokes of the rod per unit of time. This type of pump is typically used where the flow requirement of the pump is relatively low. These pumps are most effective for pumping medium to light clean oil but they lose efficiency as the oil viscosity increases, and they experience rapid wear if the pumped fluids contain abrasive media.

A second methodology is the use of a rotary positive displacement pump, typically called a progressive cavity pump. These pumps typically use an offset helix screw configuration, where the threads of the screw or "rotor" portion are not equal to those of the stationary, or "stator" portion over the length of the pump. By insertion of the rotor portion into the stator portion of the pump, a plurality of helical cavities is created within the pump that, as the rotor is rotated with respect to the pump housing, cause a positive displacement of the fluid through the pump. To enable this pumping action, the surface of the rotor must be sealingly engaged to that of the stator, which also typically is an integral part of the housing. This sealing provides the plurality of cavities between the rotor and stator, which "progress" up the length of the pump when the rotor rotates with respect to the housing. The sealing is typically accomplished by providing at least the inner bore or stator surface of the housing with a compliant material such as nitrile rubber. The outermost radial extension of the rotor pushes against this rubber material as it rotates, thereby sealing each cavity formed between the rotor and the housing to enable positive displacement of fluid through the pump when rotation occurs relative to the rotor-housing couple. Rotation of the rotor relative to the housing is accomplished by extending a rod, rotatably driven by a motor at the surface, down the borehole to connect to one end of the rotor exterior of the housing. At the lower end of the pump, an inlet is formed, and at the upper end of the pump, production tubing extends from the pump outlet to a receiving means on the surface, such as a tank, reservoir or pipeline. Because of the compliant and durable stator, progressive cavity pumps are more tolerant of viscous and abrasive fluids than other pump types.

One issue encountered with progressive cavity pumps is degradation of the pump components at high temperatures. To operate effectively over a sustained period of time, the compliant seal between the rotor and housing must maintain its resiliency. The material used for effectively forming this seal, typically nitrile rubber, encounters temperature-based resiliency breakdown if the ambient to which the material is exposed exceeds approximately 250 degrees F. Thus, in fields with naturally occurring high downhole temperatures and in fields where steam injection is used to free heavy oil, such as tar sand, from the formation, the temperature of the oil will often exceed the 250 degree F. threshold, and rapid pump degradation will occur. Although other sealing materials have been used to form the rotor-to-pump seal, they are compromises in terms of either performance or cost, and thus have received limited success in the marketplace.

A third artificial lift methodology is the use of the electric submersible pump. These pumps typically are composed of a multi-stage centrifugal pump attached to an electric motor that is located in the wellbore. The motor is located immediately below the pump, with a rotary drive shaft running up from the motor through a seal that prevents the entry of wellbore fluid into the motor. The pump is normally located near the bottom of the well, proximate the production zone, with the inlet at the lower end, and the outlet at the upper end of the pump, discharging into the production tubing. An electrical power cord from the surface is clamped to the outside of the production tubing and the pump, so that it can deliver power through the annulus of the wellbore, to the motor. In high temperature pumping applications such as those mentioned above, the temperature of the well plus the normal temperature rise of an electric motor tends to cause thermal breakdown of the electrical insulation, causing failure of the motor or the wiring. As a result, the use of this artificial lift method is limited to wells having a moderate temperature.

As an example, the temperature operating limits on the pump components have limited the use of progressive cavity pumps and electric submersible pumps in the recovery of heavy oil from boreholes. These deposits are often referred to as "tar sand" or "heavy oil" deposits due to the high viscosity of the hydrocarbons which they contain. Such tar sands may extend for many miles and occur in varying thicknesses of up to more than 300 feet. The tar sands contain a viscous hydrocarbon material, commonly referred to as bitumen, in an amount, which ranges from about 5 to about 20 percent by weight. Bitumen is usually immobile at typical reservoir temperatures. Although tar sand deposits may lie at or near the earth's surface, generally they are located under a substantial overburden or a rock base which may be as great as several thousand feet thick. In Canada and California, vast deposits of heavy oil are found in the various reservoirs. The oil deposits are essentially immobile, and are therefore unable to flow under normal natural drive, primary recovery mechanisms. Furthermore, oil saturations in these formations are typically large, which limits the injectivity of a fluid (heated or cold) into the formation.

Several in-situ methods of recovering viscous oil and bitumen have been the developed over the years. One such method is called Steam Assisted Gravity Drainage (SAGD) as disclosed in U.S. Pat. No. 4,344,485 which is incorporated by reference herein in its entirety. The SAGD operation requires placing a pair of coextensive horizontal wells spaced one above the other at a distance of typically 5-8 meters. The pair of wells is located close to the base of the viscous oil and bitumen. The span of formation between the wells is heated to mobilize the oil contained within that span which is done by circulating steam through each of the wells at the same time. The span is slowly heated by thermal conductance.

After the oil in the span is sufficiently heated, it may be displaced or driven from one well to the other, thereby establishing fluid communication between the wells. The steam circulation through the wells is then terminated. Steam injection at less than formation fracture pressure is initiated through the upper well and the lower well is opened to produce liquid thereto from the formation. As the steam is injected, it rises and contacts cold oil immediately above the upper injection well. The steam gives up heat and condenses; the oil absorbs heat and becomes mobile as its viscosity is reduced. The condensate and heated oil drain downwardly under the influence of gravity. The heat exchange occurs at the surface of an upwardly enlarging steam chamber extending up from the wells, as oil and condensate are produced through the recovery wellbore at the bottom of the steam chamber. In a heavy oil reservoir, the preferred pumping means to produce such oil in the recovery borehole would typically be the progressive cavity pump. However, since the recovery wellbore of a SAGD system is typically at a temperature in the range of 300 to 450 degrees Fahrenheit, the use of the progressive cavity pump with optimal sealing materials for pump longevity and cost is not possible due to the temperature.

A further method of well bore fluid recovery is known as jet pumping. This methodology takes advantage of the venturi effect, whereby the passage of fluid through a venturi causes a pressure drop, and the oil being recovered is thereby brought into the fluid stream. To accomplish this in a well, a hollow string is suspended in the casing to the recovery level, and a venturi is provided in a housing adjacent an orifice which extends into the oil in the bore, a fluid is flowed down the string and through the venturi and thence back out the well in the space between the string and casing. The oil is pulled into the stream and carried to the surface therewith, whence it is separated from the fluid. The fluid is recycled and again directed down the well. This technique suffers from poor system energy efficiency and the need for extensive equipment at the surface, the cost of which typically exceeds the value of the oil which may be recovered. Jet pumping is less effective with viscous fluids than with lighter fluids because it is more difficult for a venturi effect to pull viscous fluids into the jet pump mixing tube, and the mixing tube must be substantially longer to accomplish adequate fluid mixing in the pump.

An additional method of well bore fluid recovery is gas-assisted lifting, in which natural gas is compressed at the surface and made to flow through the annulus between the production tubing and the well casing to the lower portion of the well, where it is injected through an orifice into the production tubing. The addition of this gas to the liquid in the production tubing reduces the density of the hydrostatic column of produced fluid so that the natural pressure of the formation is then adequate to drive the produced fluid to the surface. This technique suffers from the fact that uniform mixing of the gas with the fluid in the production tubing is more difficult to achieve in viscous fluids. Gas-assisted lifting is further limited by the fact that it depends upon there being adequate pressure in the reservoir to lift the hydrostatic column of reduced density fluid to the surface.

Therefore, there exists in the art a need to provide enhanced artificial lifting methods, techniques and apparatus, having a greater return on investment and or durability.

SUMMARY OF THE INVENTION

The present invention generally provides methods, apparatus and article for the improved artificial lifting of fluids, particularly useful in high temperature environments, using a pump driven from a remote location, such as a progressing cavity pump.

In one embodiment, the invention provides a footed borehole, having an entry location from a first borehole and extending in a generally offset direction from the first borehole, and also having a horizontal component forming a landing region which would, during production, be a collection point for oil in the footed borehole. A pump, drivable from a remote location, is landed in the footed borehole in a position where the oil may collect, but at a sufficient distance from the end of the foot of the borehole that a harsh temperature condition in the foot is ameliorated at the landed location.

In one embodiment, the pump is driven by a rotating rod extending at least from the pump to the well head. Further, the pump may be a progressing cavity pump, and further, the pump is positioned at a location sufficiently near the producing interval such that the flowing pressure drop between the producing interval and the pump is minimized. A surface control on the pumping system senses the intake pressure at the pump via a downhole pressure sensor. The pump control then adjusts the pumping cycle to maintain the intake pump pressure within acceptable limits such that pump intake pressure is minimized without allowing the pump to reduce the fluid level to a level that would allow the pump to ingest gas instead of liquid. As the water-laden well fluids approach the pump, the reduced pressure at the pump causes the water in the well fluids to vaporize at the flash point temperature corresponding with the pressure at the pump. This vaporization removes heat from the fluid and causes it to be cooled to the flash temperature of the water at the pump intake pressure. Therefore by controlling the intake pressure of the pump, the intake fluid temperature can be limited as well if the fluid is water-laden as is the case with SAGD operations, thus allowing conventional flexible materials to be used in the pump. For example, the flash point of water at 50 psia (35 psig) is 281 degrees F. If the pump intake pressure is maintained between 20 psig and 35 psig, then sufficient condensed water in the well fluids would vaporize at 281 degrees F., thus removing heat and limiting the temperature of the well fluids.

In a further embodiment, the footed borehole is located in a field in which steam injection is occurring, and the temperature of the oil in the production zone of the footed bore exceeds the breakdown temperature of the material used for the seal between the rotor and housing. In a steam injection field, the steam typically is injected into the production zone in the saturated (not superheated) condition. As the well fluid rises toward the surface, the static head of liquid in the casing decreases, causing the pressure of the liquid to decrease. The decrease in pressure of the fluid causes the evolution of steam vapor from the liquid phase, this then resulting in a natural decrease in the temperature of the well fluid so that the temperature of the fluid exactly matches the saturation temperature of steam at the new pressure. The pump is positioned in the evolving region, and therefore in a lower temperature portion of the wellbore so that the pump is able to operate in the lower temperature, and therefore less severe temperature environment portion of the well. This allows the use of pumps that would not be practical for use in the higher temperature region of the well, but it does require that provision be made to pump the evolved vapor phase, or allow the vapor to bypass the pump and proceed up the annulus to the surface.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
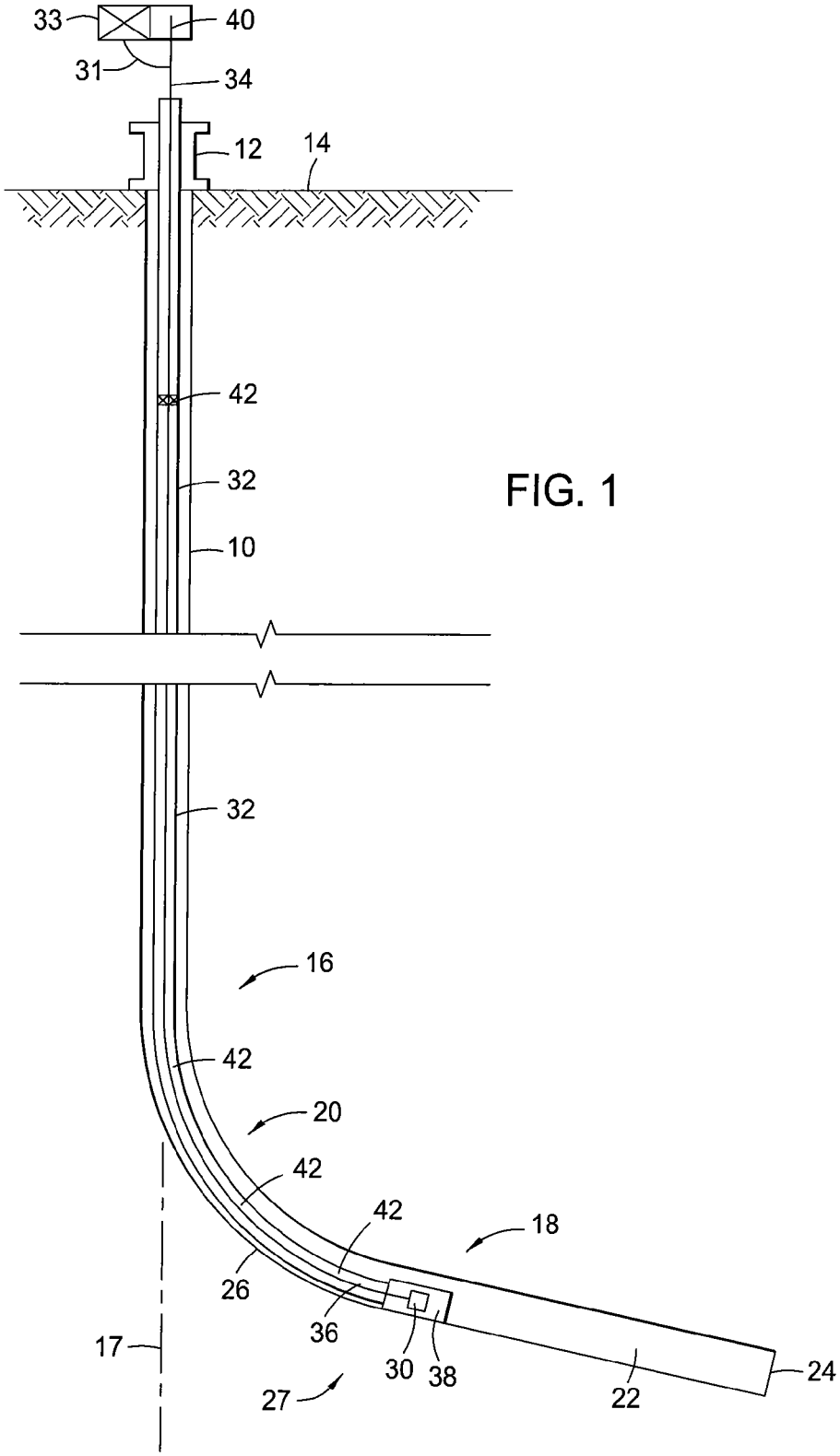
FIG. 1 is a schematic view of a wellbore, having an offset or "footed" section, located in a steam assisted recovery field, into which a pump is suspended.

Referring to FIG. 1, there is shown in schematic representation, a producing oil well having a first borehole 10 extending from a well head 12 at the opening of the borehole to the surface 14, and a lower terminus 16. At least one footed borehole 18 extends outwardly from first borehole 10, although multiple such footed boreholes may be in place and in communication with borehole 10.

Each footed borehole 18 includes an entrance section 20 at which the footed borehole 18 deviates from the centerline 17 of the first borehole 10 (in FIG. 1 adjacent the lower terminus 16 thereof), from which the footed borehole 18 extends to form a foot 22 terminating at toe 24. The angle between the centerline of the first borehole 10 and the footed borehole changes between the foot 22 and entrance section 20, such that a generally curved portion 26 is located between foot 22 and entrance section 20. As the curved section begins to decrease in curvature as the generally straight section of the foot 22 is reached, heel 27 is positioned. The generally horizontal first borehole 10 is preferably cased, whereas the footed borehole 18 is not cased, but is preferable screened, such as by placing a plurality of cylindrical screen elements (not shown) therein to allow the passage of fluid therein, but to block a portion of any sand or other particulates which will otherwise flow into the footed borehole 18. Although the first borehole 10 is shown extending downwardly into the earth beyond the opening of footed borehole 18 therefrom to reach other possible producing locations, first borehole 10 and footed borehole 18 may be formed as one continuous borehole, such that no continuing portion of first borehole 10 is provided Referring still to FIG. 1, a tube 32, having a rod 34 suspended therein, is hung from wellhead 12 and extends into the first bore 10 to terminate within footed borehole 18. At the end of tube 32 terminating within the footed borehole 18 is located a pump 38. In the preferred embodiment, pump 38 is a progressing cavity pump, which is powered downhole by rod 34. Rod 34 extends through the entire length of the tube 32, terminating at one end thereof in engagement with the rotor (shown in FIGS. 2 and 3) of the progressing cavity pump, and at the second end thereof in engagement with a drive motor 40, typically an electric motor, shown schematically and located adjacent the wellhead 12. As rod 34 is rotated, it causes the pump to pressurize the well fluids and pump them up the tube 32 through which rod 34 extends. To enable rod 34 to rotate in tube 32 without interfering engagement with the tube 32, a plurality of stabilizers 42 may be provided in the tube through which the rod extends to space rod 34 from the inner surface of tube 32, and which stabilizers are substantially permeable to oil being pumped therethrough from pump 38 to well head 12. Additionally, a pressure sensor 30 is provided on the exterior of the pump, and communicates the pressure at the pump intake to a controller 33 (shown schematically) at the surface 14 through wire 31.

Figure 2:
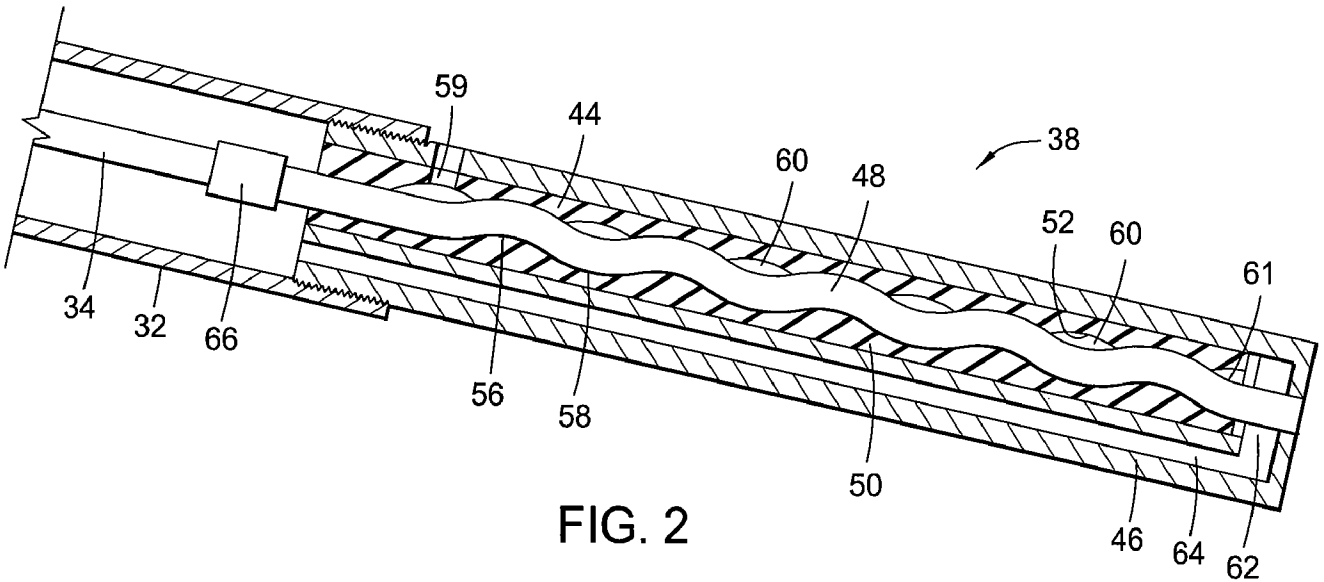
FIG. 2 is a partial sectional view of a progressive cavity pump.

Referring now to FIG. 2, the details of the pump 38 are shown. In the preferred embodiment, pump 38 generally includes an outer housing 46 which together with elastomeric portion 50 forms a stator 44 of the pump 38. Stator 44 is preferably formed as a helical female elastomeric portion 50, formed as a helical path within a cylindrical envelope to create a helical bore 52, and having an elastomeric section which, at a minimum, is an elastomeric coating on the inner bore surface of the stator housing 46. Received within helical bore 52 is a helical rotor 48, which has a generally helical outer profile 58. Rotor 48 likewise includes eccentricity, i.e. an offset of its center of rotation from the centerline of the stator 44, such that the rotor 48 sweeps through a cylindrical envelope of equal or slightly greater diameter of the cylindrical envelope of the inner face of the elastomeric section 50 of stator 44. Thus, as the rotor 48 turns within stator 44, a series of helical cavities 60 are formed between stator 44 and rotor 48, which cavities "progress" down the longitudinal bore of the pump 38 as relative rotation between stator 44 and rotor 48 occurs. The first cavity of the pump 38 is connected to an inlet 59, which is fluidically connected to the wellbore. The last cavity 61 formed between rotor 48 and stator 44 empties well fluids under pressure into the tubing 32. Well fluids are propelled into the tubing 32 under sufficient pressure to raise them to the wellhead 12. The length of the pump 38, the pitch of the rotor 48 and stator 44, and thus the number of helical cavities 60 formed in the pump 38, are selected to ensure that the pressure in the pump exit provides sufficient hydrostatic head to propel well fluids to the surface 14. The relative rotational motion between rotor 48 and stator 44 is typically in the range of 60 to 400 rpm.

Referring still to FIG. 2, pump housing 46 is coupled to the tube 32, such as by mating threads and thus threaded engagement, and is thus locked against rotation thereby. Rod 34, extending within tube 32, is coupled to rotor 56 via threaded coupling 66, connecting rotor 48 to rod 34. Thus, when rod 34 is rotated, rotor 48 turns within stator 44 to pump well fluids from inlet 59, progressively through cavities 60, and thence to exit cavity 62, through outlet conduit 64, and thus up through tube 32 to the wellhead 12, where it is recovered into a tank, reservoir or pipeline.

Figure 3:
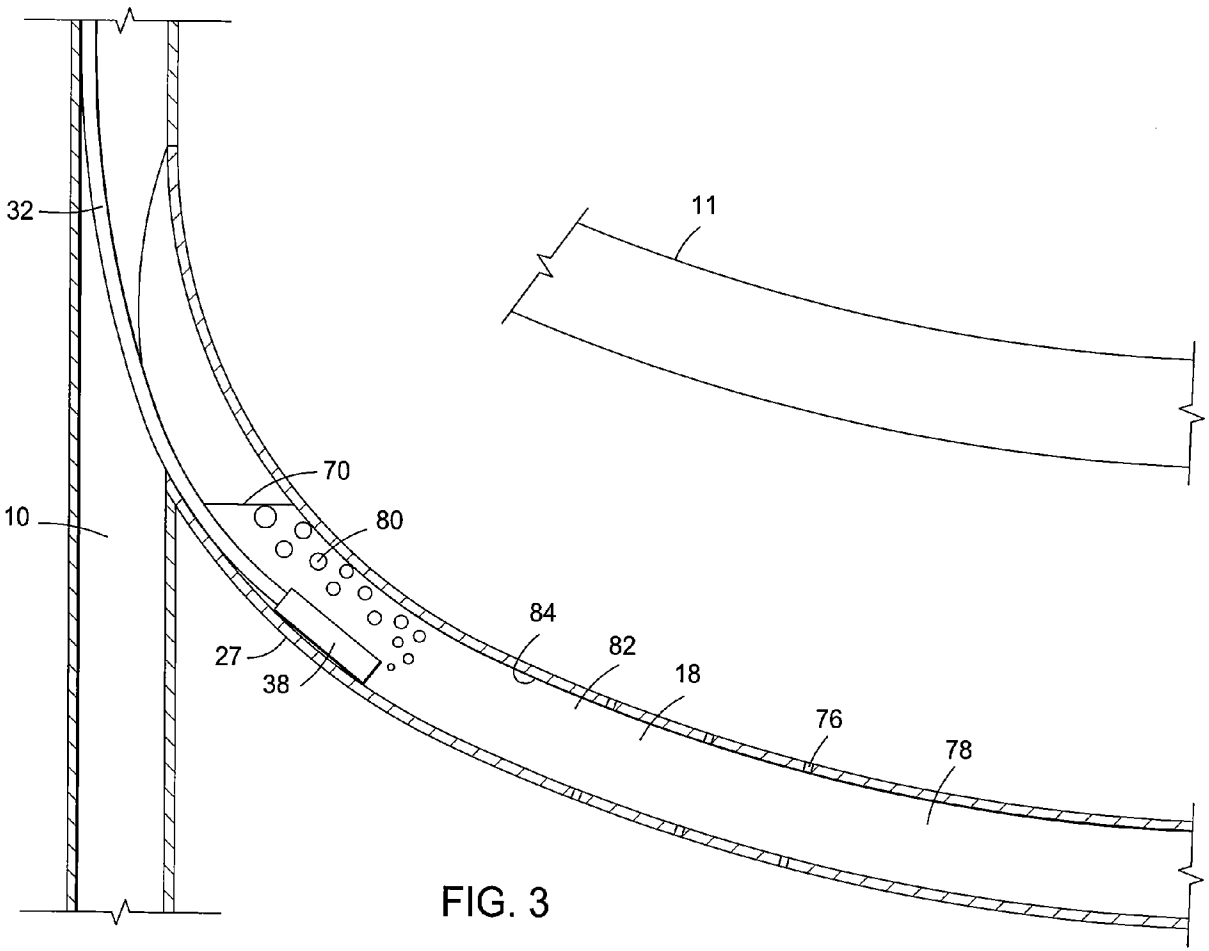
FIG. 3 is a sectional view of the downhole portion of the wellbore shown in FIG. 1.

Referring now to FIG. 3, there is shown the pump 38 in location at the heel 30 section of footed wellbore 18. As shown in FIG. 3, pump 38 is landed at the base of the heel 30, positioned at the lowest side of the footed borehole 18. The pump 38 is positioned within the well fluid, such as oil, steam vapor, and steam condensate, such that the liquid extends above the pump 38 in the bore 18 to at least a position above the pump 38. Thus the oil extends to an interface 70, at which the oil meets a pressure near that of atmospheric pressure with the additional pressure of gas and steam vapor in the tube 32, i.e., a natural height based upon the hydrostatic pressure of the oil in the footed borehole 18. In the embodiment shown, the footed wellbore 18 extends in a field in which secondary recovery of fluid is being undertaken, typically using heat in the form of steam to free the oil from the surrounding formation. Thus, typically, steam is injected at very high pressure from a steam generator (not shown) into injection wellbores 11 above the footed borehole 18, thereby reducing the viscosity of the heavy oil which it encounters by raising the temperature thereof. This heavy oil, having an elevated temperature, then flows under gravity to the footed borehole 18 located below the injection borehole for recovery thereof. The heavy oil will enter the footed borehole 18 at high temperatures, typically in the 300 to 500 degree Fahrenheit range, and having steam condensate mixed with the oil.

As the heel 30 of the footed borehole 18 has a slope, the oil collected therein with have an ambient pressure gradient from the lowest portion 78 of the footed borehole 18 to the interface 70, with the pressure being highest at the lowest extension thereof into the earth, and lowering to the interface pressure at the interface 70.

The steam condensate mixed with the oil will remain liquid until the pressure of the column of oil in the footed borehole 18 is no longer sufficiently high to maintain the steam condensate in liquid state at the localized temperature and pressure of the steam. Thus, when the steam condensate reaches a portion of the column of the oil at which it can no longer exist in a liquid or dissolved state, a portion of it vaporizes, thereby lowering the temperature of the surrounding ambient, in this case the oil. The steam condensate forms bubbles 80 due to the reduced pressure, and the bubbles form first at a zone 82 in the oil column at which the hydrostatic pressure and temperature conditions dictate that the steam condensate shall come out of solution. Thus the bubbles 80, at formation in the zone 82, cool the oil, and the bubbles thence flow upwardly in the oil column and thence into the open bore of the well. The bubbles 80 also preferentially rise in the oil to the upper surface 84 of the footed wellbore 18, and thus pass above the pump 38 and they are therefore not sucked into the pump entry when pump 38 is operating. The oil at the location of the pump 38, cooled by the vaporization of steam condensate, is thus in a temperature range below 280 degrees Fahrenheit, and thus the use of nitrile rubber as the stator coating material is enabled.

The position of the pump 38 within the footed wellbore is determined by a consideration of the expected interface 70 position within the well bore and the expected temperature of the oil entering the footed wellbore, from which a hydrostatic head pressure profile can be calculated. As a result, the likely location at which bubbles will form and thus cool the oil can be predicted. Furthermore, the pump is operated to pump the hot fluids in the wellbore 18 such that the pressure at the pump inlet remains in the 20 to 35 psig range, which ensures that the pump will not run dry, but also ensures that the temperature of the oil adjacent the pump is cooled by the evolution of steam bubbles 80 from the fluid. The lower end of the pressure range ensures that some well fluid is present above the pump 32 inlet 59, equivalent to approximately 5 psi of head less the pressure exerted by steam and gas in the wellbore. The upper limit of the pressure range is selected to ensure that the pressure is sufficiently low, at the temperatures the fluid is expected to be present in the footed borehole 18, such that bubbles 80 will form adjacent to the inlet 59 to cool the fluid surrounding the pump 32. Thus, the controller controls the operation of drive motor 40, to cease pumping operation when the lower limit of the range is reached, and increase the pumping rate by increasing the rotation of the drive shaft 34 and thus reduce the quantity of fluid above the pump to ensure bubble evolution adjacent the pump, when the upper pressure limit is approached. The pump 38 is located in a position above (i.e., closer to the wellhead) than where the bubbles form, such that the formed bubbles will have risen to the upper surface of the footed wellbore 18 before they reach the pump 38. As the zone 82 in which the bubbles form will extend some vertical space in the zone, the pump 38 should be located horizontally offset from the uppermost portion of the zone 82. Thus vapor can be prevented from entering, and vapor locking, the pump 38, while the advantages of the cooling of the oil by the cooling effect of the steam vaporizing from solution, can be taken advantage of to use lower temperature resistance seal materials in the pump 38. Alternatively, the pump intake could be shielded, where bubble 80 formation is likely to occur below the pump 32, such as if the pump 32 is positioned in a vertical wellbore such as wellbore 10.

By positioning the progressing cavity pump 38 in a position where the oil in the borehole is naturally cooled, the pump may be used with nitrile rubber sealing components, and thus the cost and durability advantages of these materials may be enjoyed in the recovery of well fluids from steam injection fields.

While the foregoing is directed to embodiments of the present invention, other and further embodiments of the invention may be devised without departing from the basic scope thereof, and the scope thereof is determined by the claims that follow.

The invention claimed is:

1. A method of pumping well fluids from a wellbore, wherein the wellbore includes a footed portion having an upper surface and a lower surface separated by a wellbore span, comprising:

dissolving steam in the well fluids, whereby at least a portion of the steam forms a steam condensate;

vaporizing at least a portion of the steam condensate, thereby forming a cooling zone in a tubular in the wellbore;

cooling at least a portion of the well fluids at and adjacent the cooling zone in the tubular; and positioning a pump on the lower surface of the footed portion above the cooling zone and in a portion of well fluids containing a mixture of gas phase and liquid phase fluids, wherein the pump has a width smaller than the span and a gap exists between the pump and the borehole upper surface.

2. The method of claim 1, wherein the pump is a progressive cavity pump having components therein having low resistance to temperature-based breakdown.

3. The method of claim 1, wherein the steam condensate, upon vaporization thereof, forms bubbles in the well fluid in the footed bore; and, the bubbles pass in the well fluid in the direction of the well head through the gap between the pump and the upper surface of the footed wellbore.

4. The method of claim 1, further including the steps of;

establishing a pressure range for the operation of the pump;

monitoring the pressure present at the pump;

directing the pumping rate of the pump in response to the pressure at the pump.

5. The method of claim 1, wherein the pump is an electric submersible pump having components therein having low resistance to temperature-based breakdown.

6. A method of recovering formation fluids, comprising:

mixing an additive material in the formation fluids;

decreasing a viscosity of the formation fluids;

collecting the formation fluids in a wellbore;

vaporizing a condensate of the additive material, thereby cooling the formation fluids;

positioning a pump in the cooled formation fluids, wherein a pressure at the pump inlet is between about 20 psig to about 35 psig; and recovering the cooled formation fluids.

7. The method of claim 6, further comprising injecting the additive material from an adjacent wellbore.

8. The method of claim 6, wherein the additive material comprises steam.

9. The method of claim 6, further comprising operating the pump such that the pressure adjacent a pressure adjacent the pump is sufficient to vaporize the condensate of the additive material.

10. The method of claim 6, wherein decreasing the viscosity comprises heating the formation fluids.

11. The method of claim 6, wherein the formation fluids enter the wellbore at a temperature between about 300° F. to about 500° F.

12. The method of claim 6, wherein the formation fluids enter the pump at a temperature below 280° F.

13. A method of recovering formation fluids from a formation, comprising:

injecting steam from a first wellbore into the formation;

urging the formation fluids to flow into a second wellbore;

maintaining a pressure in the formation such that at least a portion of the steam enters the second wellbore in the form of water;

providing a cooling zone in the second wellbore, wherein a pressure in the cooling zone is sufficient to vaporize the water;

positioning a pump in the cooling zone;

operating the pump to maintain the pressure in the cooling zone sufficient to vaporize the water; and operating the pump to recover the formation fluids.

14. A method of recovering formation fluids, comprising:

collecting the formation fluids in a wellbore;

vaporizing a water in the formation fluids, thereby cooling the formation fluids;

positioning a pump in the cooled formation fluids;

operating the pump to maintain a pressure in the cooling zone sufficient to vaporize the water; and recovering the cooled formation fluids.

15. The method of claim 14, wherein the cooled formation fluids surrounding the pump has a lower density than a density of the formation fluids in the cooling zone.

16. The method of claim 14, decreasing a viscosity of the formation fluids before entering the wellbore.

17. The method of claim 16, wherein decreasing a viscosity of the formation fluids comprises increasing a temperature of the formation fluids.

18. The method of claim 17, wherein increasing a temperature of the formation fluids comprises adding steam to the formation fluids.

19. The method of claim 14, wherein the pump is positioned such that at least a portion of the gas from the vaporized water is allowed to flow past the pump.

* * * * *